US011623262B2

(12) United States Patent
Uchiyama et al.

(10) Patent No.: US 11,623,262 B2
(45) Date of Patent: Apr. 11, 2023

(54) METHOD FOR INCREMENTALLY FORMING

(71) Applicant: NISSAN MOTOR CO., LTD., Yokohama (JP)

(72) Inventors: Noriko Uchiyama, Kanagawa (JP); Hirotaka Miwa, Kanagawa (JP); Shigeyuki Nakagawa, Kanagawa (JP); Ryou Murakami, Kanagawa (JP)

(73) Assignee: NISSAN MOTOR CO., LTD., Yokohama (JP)

( * ) Notice: Subject to any disclaimer, the term of this patent is extended or adjusted under 35 U.S.C. 154(b) by 176 days.

(21) Appl. No.: 17/257,933

(22) PCT Filed: Jul. 6, 2018

(86) PCT No.: PCT/IB2018/000940
§ 371 (c)(1),
(2) Date: Jan. 5, 2021

(87) PCT Pub. No.: WO2020/008826
PCT Pub. Date: Jan. 9, 2020

(65) Prior Publication Data
US 2021/0121931 A1 Apr. 29, 2021

(51) Int. Cl.
*B21D 22/18* (2006.01)

(52) U.S. Cl.
CPC ..... *B21D 22/18* (2013.01)

(58) Field of Classification Search
CPC ..... B21D 22/14; B21D 22/18; B21D 31/005; B21D 22/22; B21D 24/04; B21D 25/02; B21D 25/04
See application file for complete search history.

(56) References Cited

U.S. PATENT DOCUMENTS 3,342,051 A * 9/1967 Leszak ..... B21D 22/185 72/85
9,522,420 B2 * 12/2016 Nonomura ..... B21D 31/005
(Continued)

FOREIGN PATENT DOCUMENTS

CN 106807828 A * 6/2017 ..... B21D 31/005
DE 10317880 B3 10/2004
(Continued)

OTHER PUBLICATIONS

Translation JP09-85355A, Shima et al. Mar. 1997.*
Translation JP09-57381A, Ochiai et al. Mar. 1997.*

*Primary Examiner* — Edward T Tolan
(74) *Attorney, Agent, or Firm* — Foley & Lardner LLP

(57) ABSTRACT

A method for incrementally forming includes: preparing a tool T disposed on one side of a metal plate W, a fixing jig 1 to hold a periphery of the metal plate W, and a template P1 including a molded edge E that follows at least a part of a contour of a part to be processed F; arranging the template P1 on the other side of the metal plate W; holding the periphery of the metal plate W together with the template P1 by the fixing jig 1 to fix the metal plate W and the template P1; and moving the tool T while pressing the tool T against the metal plate W, to incrementally form the part to be processed F having a three-dimensional shape of the metal plate W.
The method enables to form the part to be processed F in high precision with no use of a molding die and thus, is effective in bringing about reducing cost of equipment and manufacturing.

10 Claims, 11 Drawing Sheets

(56) References Cited

U.S. PATENT DOCUMENTS

| | | | | |
|---|---|---|---|---|
| 10,500,629 | B2 * | 12/2019 | Roth | B21D 31/005 |
| 2001/0029768 | A1 * | 10/2001 | Okada | B21D 22/14<br>72/343 |
| 2006/0272378 | A1 | 12/2006 | Amino et al. | |

FOREIGN PATENT DOCUMENTS

| | | | | |
|---|---|---|---|---|
| DE | 102009056444 | B3 * | 3/2011 | B21D 22/26 |
| DE | 102013110855 | A1 * | 4/2015 | B21D 31/005 |
| DE | 102013019397 | B4 * | 5/2018 | B21D 31/005 |
| JP | 09-57381 | A * | 3/1997 | B21D 31/005 |
| JP | 9-85355 | A | 3/1997 | |
| JP | 11-57872 | A * | 3/1999 | B21D 31/005 |
| JP | 11-327619 | A | 11/1999 | |
| JP | 2006-51547 | A | 2/2006 | |
| JP | 4787548 | B2 | 10/2011 | |

* cited by examiner

METHOD FOR INCREMENTALLY FORMING

TECHNICAL FIELD

The present invention relates to a method for incrementally forming to be adopted for incrementally forming a metal plate into a three-dimensional shape, the method including moving a tool while pressing the tool against the metal plate with its periphery held.

BACKGROUND ART

As an example of conventional methods for incrementally forming, there may be mentioned a method disclosed in Patent Literature 1. In the method for incrementally forming disclosed in Patent Literature 1, jigs to fix a periphery of a metal plate set in a horizontal posture, a molding die arranged on a lower surface side of the metal plate, and a tool disposed on an upper surface side of the metal plate are used. Each of the jigs has a structure that can be raised and lowered. The tool has a bar shape with a processing surface at its distal end, and is movable in three-axis directions orthogonal to each other.

The method for incrementally forming includes moving the tool while pressing the distal end of the tool against the upper surface of the metal plate to plastically deform the metal plate continuously, and lowering the tool and the jigs while changing a moving path of the tool. In this way, by the method for incrementally forming, the metal plate is gradually deformed in a manner of following a surface of the molding die, and finally, a part to be processed (molded product) having a three-dimensional shape conforming to a shape of the surface of the molding die is formed.

CITATION LIST

Patent Document

Patent Document 1: Japanese Patent No. 4787548

SUMMARY OF INVENTION

Technical Problem

However, although the part to be processed to be obtained by the conventional method for incrementally forming as described above is in high precision owing to the use of the molding die, dedicated molding dies need to be prepared respectively to form parts to be processed of a plurality of types. Thus, the conventional method for incrementally forming has a problem of bringing about increasing cost of equipment and manufacturing, and such problems have not yet been solved.

The present invention has been made in view of the circumstances in the related art as described above, and an object thereof is to provide a method for incrementally forming that enables to form a part to be processed in high precision with no use of a molding die and thus, enables to bring about reducing cost of equipment and manufacturing.

Solution to Problem

A method for incrementally forming according to the present invention is a method for incrementally forming a part to be processed having a three-dimensional shape on a metal plate by using a tool disposed on one side of the metal plate, the part to be processed protruding to the other side of the metal plate. In the method for incrementally forming, a fixing jig to hold a periphery of the metal plate, and a template including a molded edge that follows a part of a contour of the part to be processed are used. Moreover, the method for incrementally forming has the feature that the template is arranged on the other side of the metal plate; the fixing jig holds the periphery of the metal plate together with the template to fix the metal plate and the template; and moving the tool while pressing the tool against the one side of the metal plate, to incrementally form the part to be processed having a three-dimensional shape on the metal plate.

Advantageous Effects of Invention

In the method for incrementally forming according to the present invention, with no use of a molding die, the template is arranged on the other side of the metal plate at a part of the part to be processed where deformations (errors) are liable to occur. In case of forming parts to be processed of a plurality of types, it is clearly less expensive to prepare the template corresponding to the part of the part to be processed than to prepare molding dies dedicated for the plurality of types.

In addition, the method for incrementally forming includes holding the periphery of the metal plate together with the template by the fixing jig to fix the metal plate and the template, and moving the tool while pressing the tool against the one side of the metal plate. At this time, in the method for incrementally forming, at the part where the template is arranged, the tool is moved in a manner of following the molded edge of the template, and the metal plate is restrained between the tool and the molded edge. In this way, by the method for incrementally forming, shape fixability of the edge of the part to be processed is increased. As a result, tension of a vertical wall of the part to be processed is increased to suppress deformation of the part to be processed.

In this way, the method for incrementally forming enables to form the part to be processed (molded product) in high precision with no use of the molding die and thus, enables to bring about reducing cost of equipment and manufacturing.

DESCRIPTION OF THE EMBODIMENTS

First Embodiment

FIG. 1 to FIG. 10 are explanatory views illustrating a first embodiment of the method for incrementally forming according to the present invention.

Figure 1:
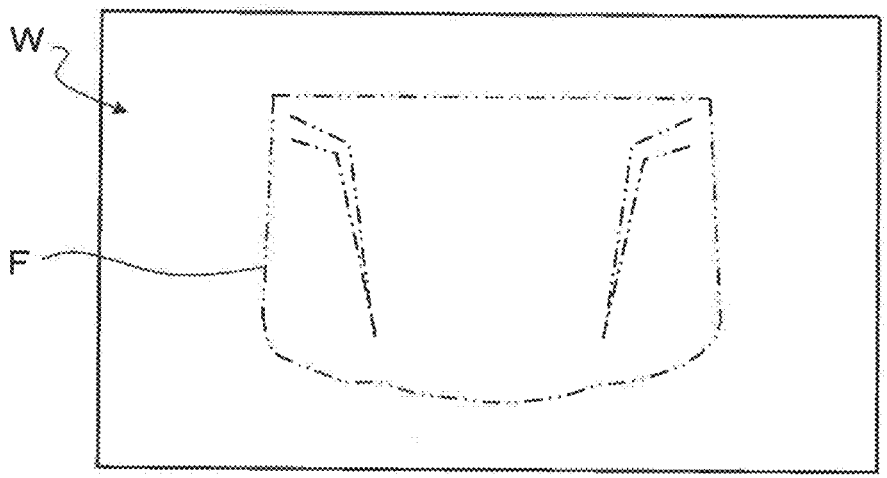
FIG. 1 is a plan view illustrating a metal plate and a part to be processed in a first embodiment of the method for incrementally forming according to the present invention.

As illustrated in FIG. 1, in the method for incrementally forming, a metal plate (blank material) W having a flat and rectangular shape is used to incrementally form a part to be processed F indicated by imaginary lines in FIG. 1 at a center of the metal plate W. The part to be processed F in the illustrated example refers to a part that is provided as a molded product by being cut off from its periphery afterward. The example of the part to be processed F is an engine hood for automobiles.

Figure 2:
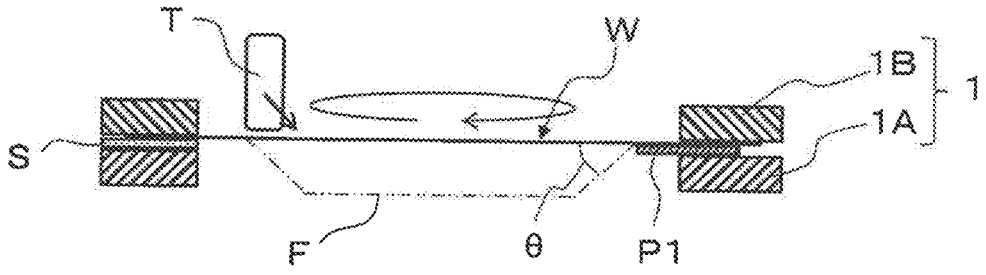
FIG. 2 is a cross-sectional view illustrating a state at a time when the incremental forming is started.
Figure 3:
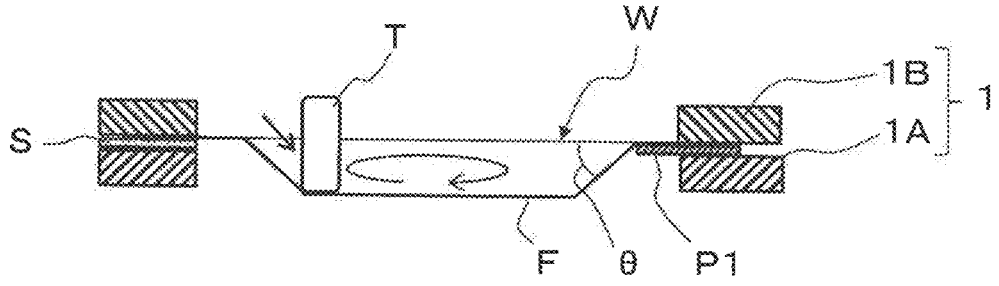
FIG. 3 is a cross-sectional view illustrating a state at a time when the incremental forming is ended.

As illustrated in FIG. 2 and FIG. 3, in the method for incrementally forming, a tool r disposed on one side of the metal plate W (upper side in the figures) is used to incrementally form the part to be processed F having a three-dimensional shape on the metal plate W, the part to be processed F protruding to the other side of the metal plate W (lower side in the figures). At this time, in the method for incrementally forming, a fixing jig 1 to hold a periphery of the metal plate V, and a template P1 including a molded edge that follows at least a part of a contour of the part to be processed F are used.

The tool T has a bar shape with a processing surface at its distal end, and is attached, for example, to a hand of a multi-axis-controlled work robot (not shown). This enables to move the tool T in three-axis directions orthogonal to each other, and also to turn about these three axes. Note that, in the method for incrementally forming, an NC machine tool or the like may be used, and the tool is attached to its tool head.

The fixing jig 1 has a rectangular frame shape, and includes a fixed plate 1A on the lower side, and a movable plate 1B on the upper side. The movable plate 1B can be raised and lowered by a drive mechanism (not shown), and is lowered to hold and fix the periphery of the metal plate W between the movable plate 1B and the fixed plate 1A. The fixing jig 1 in the illustrated example horizontally holds the metal plate W.

Figure 4:
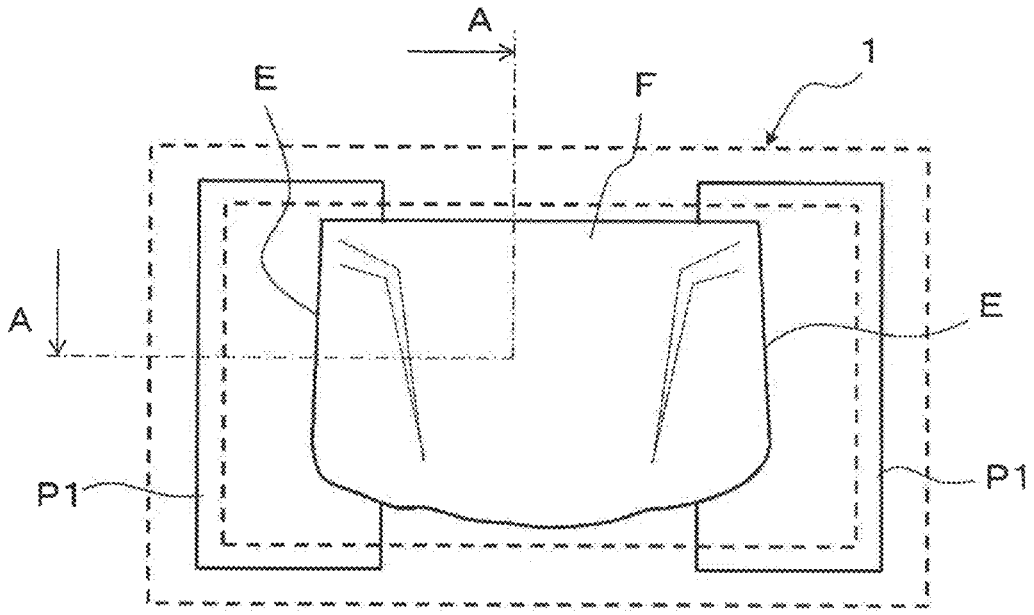
FIG. 4 is a plan view illustrating an arrangement of a fixing jig and a template relative to the metal plate.

As illustrated in FIG. 4, the templates P1 are arranged on both right-and-left sides of the part to be processed F (both right-and-left sides of the engine hood). The templates P1 have a substantially-rectangular plate member, and include, on its one side, a molded edge E that follows both the right-and-left sides of the contour of the part to be processed F.

Note that, the metal plate W has vertical-and-horizontal dimensions corresponding to outer edges of the fixing jig 1, which are indicated by dotted lines in FIG. 4. In addition, the part to be processed F is sized to be accommodated with a margin in an inner region of the fixing jig 1. In other words, the fixing jig 1 has versatility with respect to the part to be processed F and thus, is applicable to production of parts to be processed F of a plurality of types. Meanwhile, the templates P1 are each sized to be capable of being held by the fixing jig 1, and each include the molded edge E in the inner region of the fixing jig 1.

As a more preferred embodiment of the method for incrementally forming, the templates P1 are each arranged at a part where a distance from the fixing jig 1 to the contour of the part to be processed F is relatively long. The rectangular shape of the fixing jig 1 in the illustrated example has longitudinal sides in right-and-left directions, and the part to be processed F is formed at a center of the inner region. In this case, with regard to the distance from the fixing jig 1 to the part to be processed F, a distance from a transverse side of the fixing jig 1 to the part to be processed F is longer than a distance from the longitudinal side of the fixing jig 1 to the part to be processed F. Thus, the templates P1 are arranged on both the right-and-left sides of the part to be processed F.

Further, as another more-preferred embodiment of the method for incrementally forming, the templates P1 are each arranged at a part where a moving path of the tool T is switched toward a center of the part to be processed F. Still further, as still anther more-preferred embodiment of the method for incrementally forming, the templates P1 are each arranged at part where a forming angle (denoted by symbol θ in FIG. 3) being an angle to be formed between a surface of the metal plate W before the forming and a surface of the part to be processed F after the forming is relatively low.

Figure 5:
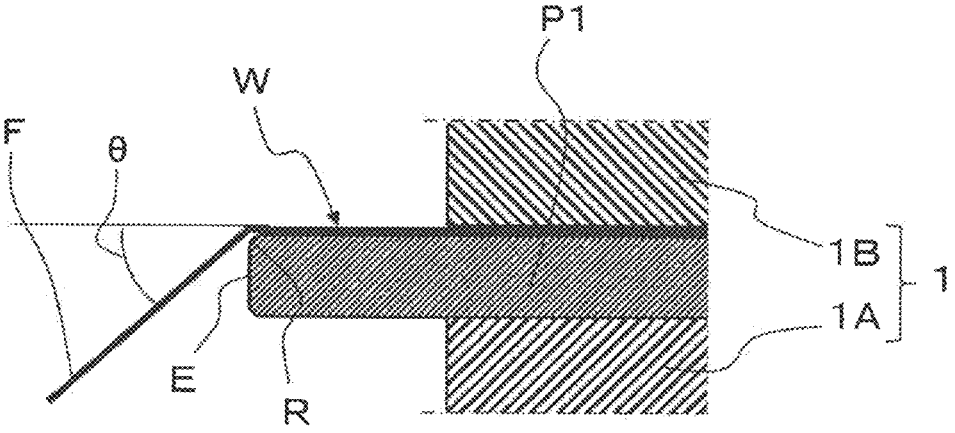
FIG. 5 is an explanatory cross-sectional view illustrating a main part of the fixing jig and the template.

Yet further, as illustrated in FIG. 5, in the method for incrementally forming, the templates P1 each have an R shape (denoted by symbol R in FIG. 5) at a corner with which the metal plate W is held in contact. In other words, the templates P1 used in the method for incrementally forming each include the R at the corner with which the metal plate W is held in contact.

In the method for incrementally forming, the tool T, the fixing jig 1, and the templates P1 described above are used, and, as illustrated in FIG. 2, FIG. 3, and FIG. 5, the templates P1 are arranged on the other side of the metal plate W (lower side in each of the figures). At this time, positions of the templates P1 are adjusted such that the molded edges E follow the contour of the part to be processed F that has not yet been processed.

Then, in the method for incrementally forming, the periphery of the metal plate W is held together with the templates P1 by the fixed plate 1A and the movable plate 1B of the fixing jig 1 to fix the metal plate W and the templates P1. With this, the templates P1 are maintained in a state in which parts corresponding to the molded edges E are extended in the inner region of the fixing jig 1.

At this time, since the templates P1 and P1 are interposed in two areas in the fixing jig 1, as illustrated in FIG. 2 and FIG. 3, it is effective to interpose spacers S each having the same thickness as that of the template P1 at parts where the templates P1 are absent. Note that, in FIG. 2 and FIG. 3, both the part where the template P1 is present and the part where the template P1 is absent are illustrated in cross-section taken along the line A-A in FIG. 4.

Next, in the method for incrementally forming, on the one side of the metal plate W, a distal end of the tool T is pressed against the contour of the part to be processed F, and then horizontally moved. In this way, in the method for incrementally forming, the moving path of the tool T is repetitively switched and lowered while the metal plate W is continuously subjected to plastic deformation, to incrementally form the part to be processed F having the three-dimensional shape on the metal plate W.

Figure 6:
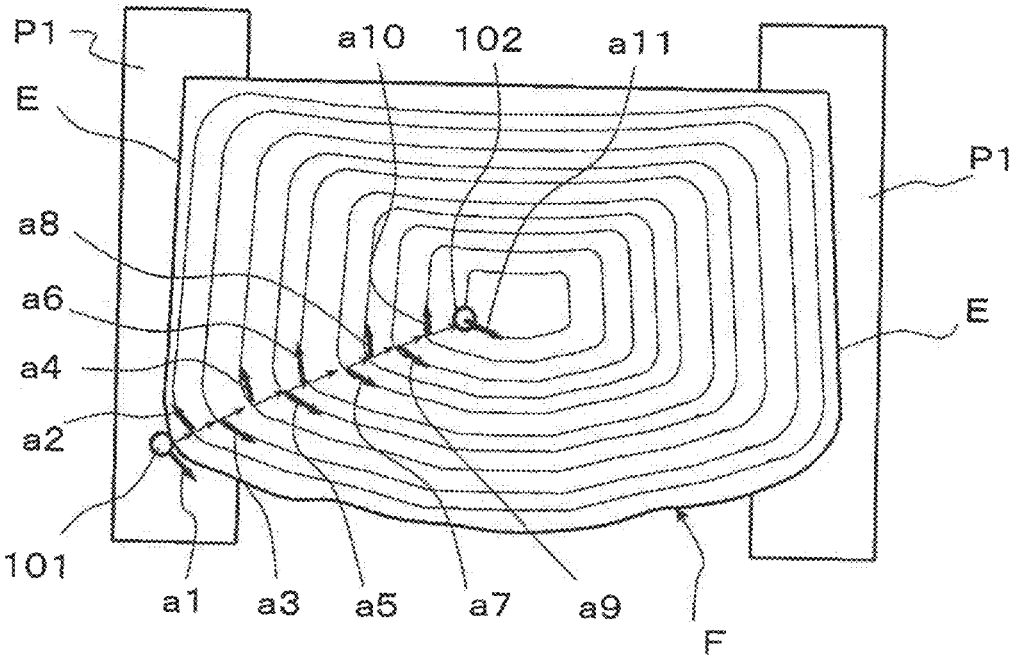
FIG. 6 is a plan view illustrating a moving path of a tool.

More specifically, in the method for incrementally forming, as illustrated in FIG. 6, a start point 101 is set in one of areas on the contour of the part to be processed F (a corner portion in the illustrated example). Then, the tool T is pressed against the start point 101, and is orbitally moved in one direction indicated by an arrow a1 in FIG. 6. This orbital path is a path following the contour of the part to be processed F.

At this time, in the method for incrementally forming, since the templates P1 and P1 are arranged on both the right-and-left sides of the part to be processed F, the tool T is moved in a manner of following the molded edge E of each of the templates P1. Thus, at the parts where the templates P1 are arranged, by restraining the metal plate W between the tool T and the molded edges E, shape fixability of the edges of the part to be processed F can be increased.

Next, in the method for incrementally forming, when the tool T reaches the start point 101, as indicated by thin arrows in FIG. 6, the tool T is moved (moved on a pitch-by-pitch basis) toward the center of the part to be processed F, and is lowered by a predetermined amount. After that, in the method for incrementally forming, as indicated by a thick arrow a2 in FIG. 6, the tool T is orbitally moved in a direction a2 reverse to the initial moving direction a1.

Subsequently, in the method for incrementally forming, the tool T is orbitally moved (thick arrows a3 to all), and moved on the pitch-by-pitch basis (thin arrows) and lowered, repetitively. In this way, by the method for incrementally forming, the forming is performed in a manner that the start of the forming illustrated in FIG. 2 shifts to the end of the forming illustrated in FIG. 3, that is, in a manner that the center of the metal plate W is gradually pressed down. At this time, the orbital path of the tool T, which is a path following the contour of the part to be processed F, becomes shorter toward the center of the part to be processed F. Note that, although pitches between the orbital paths (amounts of the movement on the pitch-by-pitch basis) are illustrated on an exaggerated scale in FIG. 6 for the sake of convenience, actual pitches between the orbital paths are small.

Meanwhile, by the method for incrementally forming, as described above, the shape fixability of the edges of the part to be processed F is increased by the templates P1 arranged on both the right-and-left sides of the part to be processed F. Thus, tension of a vertical wall (molded surface) of the part to be processed F is increased at least in ranges of the molded edges E. With this, a deformation of the part to be processed F is suppressed.

Then, by the method for incrementally forming, as illustrated in FIG. 6, at a time point when the tool T finally reaches an end point 102, the part to be processed F is formed to protrude to the other side (lower side) of the metal plate W.

In the above-described method for incrementally forming, with no use of a molding die, the templates P1 are arranged on the other side of the metal plate W at parts of the part to be processed F where deformations (errors) are liable to occur. In case of forming the parts to be processed F of the plurality of types, it is clearly less expensive to prepare the templates P1 corresponding to at least the parts of the part to be processed F than to prepare molding dies dedicated for the plurality of types.

In this way, the above-described method for incrementally forming enables to form the part to be processed (molded product) F in high precision with no use of the molding die and thus, enables to bring about reducing cost of equipment and manufacturing. Note that, when the part to be processed F is provided as the molded product, its periphery is cut off.

Figure 7:
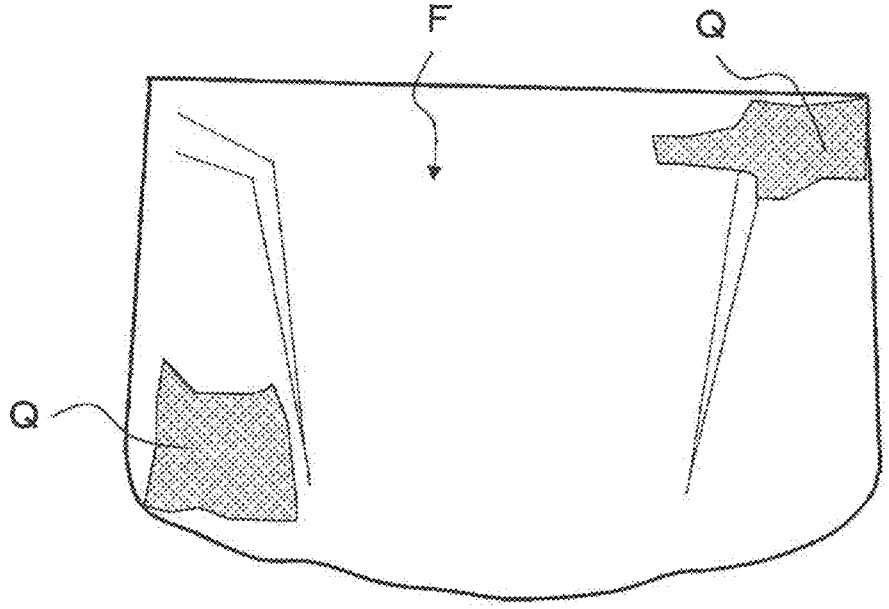
FIG. 7 is a plan view illustrating a distribution of deformed regions in the part to be processed.

Note that, as illustrated in FIG. 6, although the tool T is orbitally moved in most of the region when the incremental forming is performed from the corner portion of the part to be processed F as the start point 101, at the corner, the tool T is moved on the pitch-by-pitch basis, that is, the tool T is moved toward the center of the part to be processed F. Thus, load by the movement on the pitch-by-pitch basis is applied to the part to be processed F and thus, load is applied to an entirety of the part to be processed F in a manner of folding the entirety along a diagonal. As a result, when the forming is performed with no use of the templates P1, as illustrated in FIG. 7, deformed regions Q and Q are liable to be formed at the lower-left corner portion and at a diagonal upper-right corner portion.

In contrast, in the above-described method for incrementally forming, the templates P1 and P1 arranged on both the right-and-left sides of the part to be processed F cover parts where the moving path of the tool T is switched toward the center of the part to be processed F, that is, cover the corner portions. Thus, shape fixability of the corner portions is increased, whereby deformations of the corner portions can be suppressed.

Figure 8:
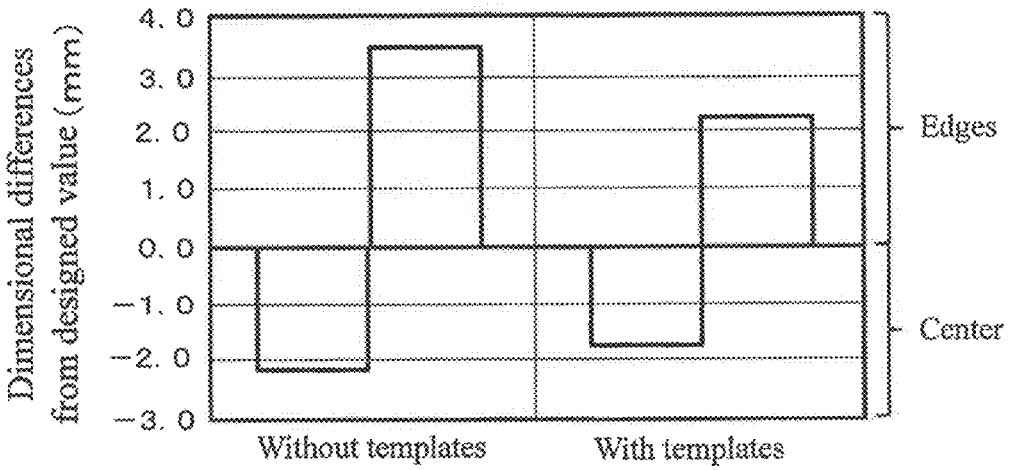
FIG. 8 is a graph showing the relationship between whether or not the template is present and formation errors of the metal plate.

FIG. 8 is a graph showing the relationship between whether or not the templates P1 are prepared and formation errors of the metal plate W. The formation errors refer to differences between a designed value and actual measured values of the part to be processed F. Among the formation errors, formation errors in a case where the templates are present are shown on the right-hand side of FIG. 8, and formation errors in a case where the templates are not present are shown on the left-hand side of FIG. 8. The errors on the right-hand side are clearly smaller than the errors on the left-hand side at any of the edges and the center.

Figure 9:
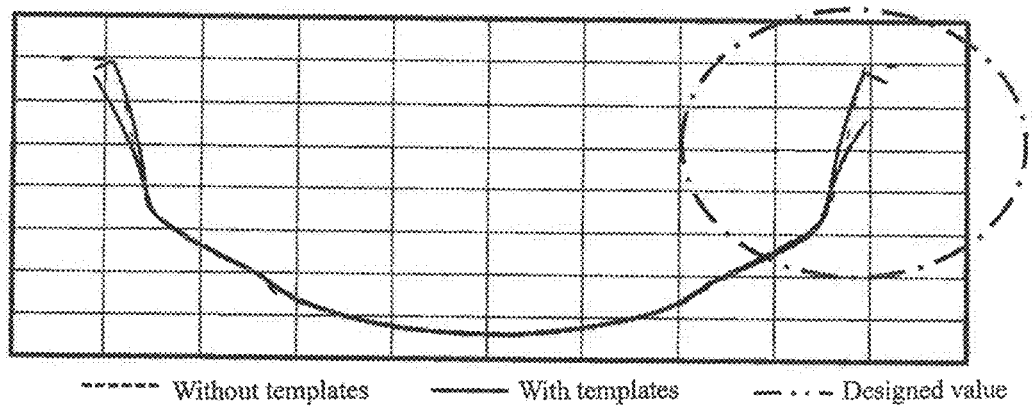
FIG. 9 is a graph showing the relationship between whether or not the template is present and deformation amounts of the metal plate.
Figure 10:
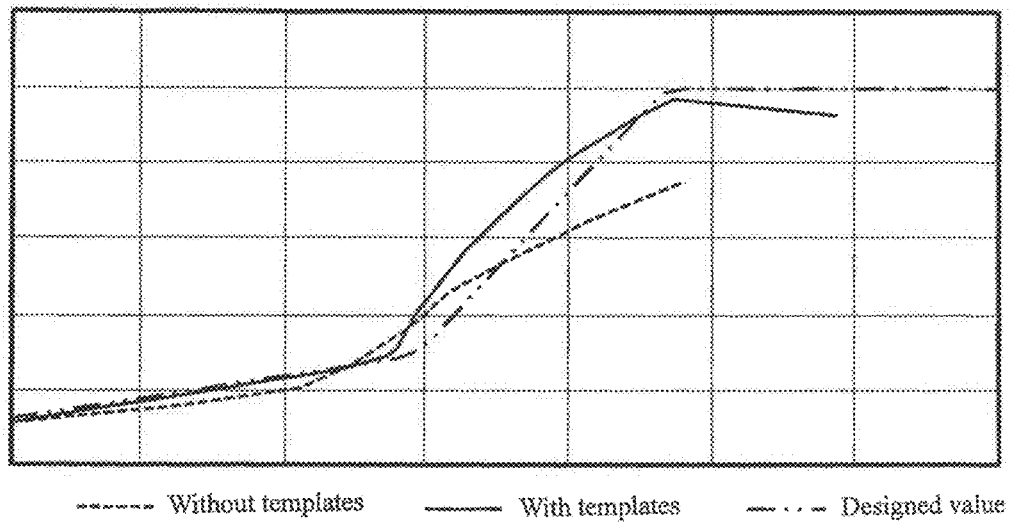
FIG. 10 is a cross-sectional view illustrating a main part in FIG. 9.

In addition, FIG. 9 and FIG. 10 are each a graph showing the relationships between whether or not the templates P1 are present and deformation amounts of the metal plate W. These graphs conform to the cross-sectional shape of the part to be processed F. The deformation amounts refer to differences between a designed value indicated by two-dot chain lines shown in the figures and actual measured values. In the central region, the deformation amounts are small irrespective of whether or not the templates are present. Meanwhile, in the edge region, the deformation amount in the case where the templates are present (solid lines) is clearly smaller than the deformation amount in the case where the templates are not present (dotted line).

In the incremental forming, when the templates are not used, the tool T is pressed against a position away from the fixing jig 1 of the metal plate W (position where the metal plate W is not restrained). Thus, the metal plate W is liable to be deflected downward and thus, the shape fixability of the edges cannot be secured due to spring-back. In other words, without the templates, the vertical wall (molded surface) of the part to be processed F becomes a gentle slope and thus, the deformation amount relative to the designed value increases. Such an increase in deformation amount conspicuously occurs as the distance from the fixing jig 1 to the contour of the part to be processed F becomes longer, and as the forming angle θ becomes smaller.

As a countermeasure, in the method for incrementally forming, the templates P1 are each arranged at the part where the distance from the fixing jig 1 to the contour of the part to be processed F is relatively long, and the templates P1 are each arranged at the part where the forming angle θ is relatively small.

This enables, in the method for incrementally forming, to increase the shape fixability of the edges of the part to be processed F by the templates P. Thus, the deformation amount of the vertical wall of the part to be processed F can be reduced at the parts where the metal plate W is liable to be deformed. Thus, the method for incrementally forming enables to form the part to be processed F (molded product) in high precision.

In addition, the templates P1 used in the method for incrementally forming each include the R at the corner portion with which the metal plate W is held in contact. With this, in the method for incrementally forming, at the time of folding the metal plate W in a manner of following the molded edge E of each of the templates P1 by the tool T, stress concentration at the folded parts is alleviated, and a decrease in thickness of the plate is also suppressed.

In each of the templates P1, it is also effective to perform surface treatment for reducing a friction coefficient at least on a contact surface with which the metal plate W is held in contact (upper surface in the illustration). In this case, at the time of the incremental forming, the metal plate W is slid slightly inward. This enables to suppress generation of excessive tensile stress to the metal plate W, and to increase the shape fixability of the edges of the part to be processed F. Note that, since the periphery is cut off from the metal plate W afterward, there is no risk that a deformation of the periphery has influence on the precision of the part to be processed F.

FIG. 11 to FIG. 17 are explanatory views illustrating second to sixth embodiments of the methods for incrementally forming according to the present invention. In the embodiments described below, parts equivalent to those of the first embodiment are denoted by the same reference symbols to omit detailed description thereof.

Second Embodiment

Figure 11:
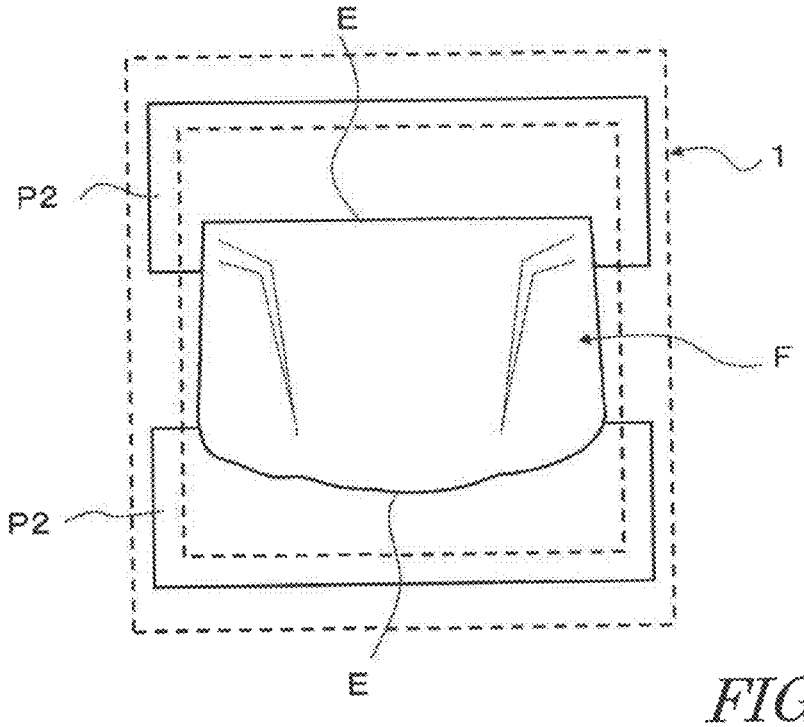
FIG. 11 is a plan view illustrating a second embodiment of the method for incrementally forming.

The fixing jig 1 used in a method for incrementally forming illustrated in FIG. 11 has a rectangular frame shape with its long sides in upper-and-lower directions. Thus, in this method for incrementally forming, templates P2 and P2 are arranged at the parts where the distance from the fixing jig 1 to the contour of the part to be processed F is relatively long, that is, at parts on both upper-and-lower sides of the contour of the part to be processed B. When the part to be processed B is an engine hood for automobiles, the templates P2 and P2 are arranged on two sides corresponding to a front edge and a rear edge. The molded edges E and E of the templates P2 and P2 follow the respective sides corresponding to the front edge and the rear edge of the part to be processed B.

Similar to the above-described embodiment, this method for incrementally forming includes holding the periphery of the metal plate W together with the templates P2 by the fixing jig 1 to fix the metal plate W and the templates P2, and moving the tool T while pressing the tool T against the one side of the metal plate W, to incrementally form the part to be processed F. At this time, in the method for incrementally forming, since the forming is performed while restraining the metal plate W between the tool T and the molded edges E of the templates P2, the shape fixability of the edges of the part to be processed F is increased. As a result, the tension of the vertical wall (molded surface) of the part to be processed F is increased to suppress the deformation of the part to be processed F. This enables to form the part to be processed F in high dimensional precision.

Third Embodiment

Figure 12:
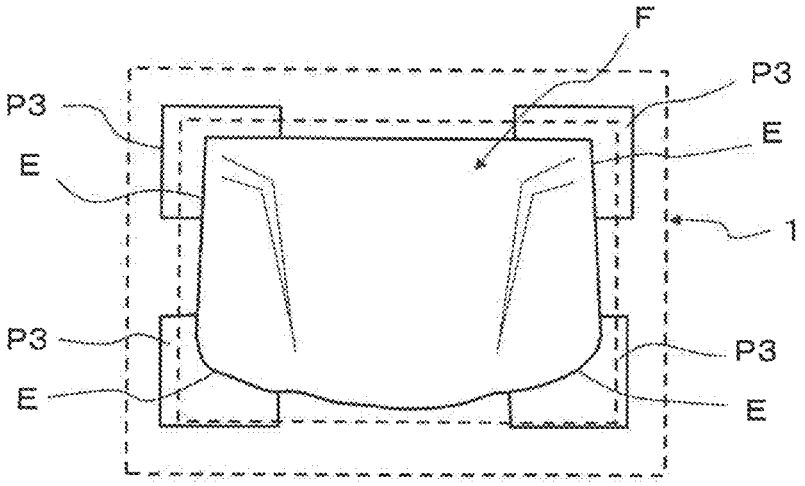
FIG. 12 is a plan view illustrating a third embodiment of the method for incrementally forming.

The fixing jig 1 used in a method for incrementally forming illustrated in FIG. 12 has a rectangular frame shape with its long sides in the right-and-left directions. In this method for incrementally forming, templates P3 are arranged at the corner portions of the part to be processed F as the parts where the moving path of the tool T is switched toward the center of the part to be processed F. Note that, when the moving path of the tool T is the same as that exemplified above in FIG. 6, the part where the moving path of the tool T is switched is one of the corner portions. However, as described above, in the part to be processed B, since the deformed regions Q are liable to be formed in two of the areas, specifically, at the part where the moving path is switched and at its diagonal position, the templates P3 are more preferably arranged in both the two areas.

Meanwhile, in the illustrated example, the templates P3 are arranged in all the four corner portions. The arrangement in the method for incrementally forming in this case is equivalent to an arrangement in which the templates P3 are arranged not only the parts where the moving path of the tool T is switched toward the center of the part to be processed F but also the parts where the distance from the fixing jig 1 to the contour of the part to be processed F is relatively long.

This method for incrementally forming also includes holding the periphery of the metal plate W together with the templates P3 by the fixing jig 1 to fix the metal plate W and the templates P3, to incrementally form the part to be processed F by the tool T. In addition, by the method for incrementally forming, the shape fixability of the edges of the part to be processed F is increased at the parts where the templates P3 are arranged. As a result, the tension of the vertical wall (molded surface) of the part to be processed F is increased to suppress the deformation of the part to be processed F. In this way, the part to be processed F is formed in high dimensional precision.

Fourth Embodiment

Figure 13:
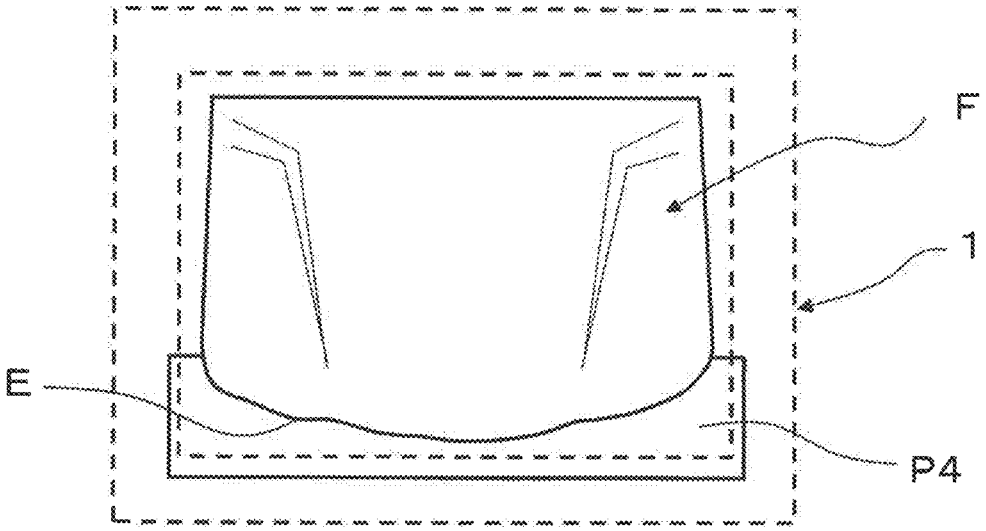
FIG. 13 is a plan view illustrating a fourth embodiment of the method for incrementally forming.

The fixing jig 1 used in a method for incrementally forming illustrated in FIG. 13 has a rectangular frame shape with its long sides in the right-and-left directions. In FIG. 13, a template P4 is arranged in a manner of following a lower part of the contour of the part to be processed B. When the part to be processed B is an engine hood for automobiles, the template P4 is arranged in a manner of following one side corresponding to the front edge. The molded edge E of the template P4 follows the side corresponding to the front edge of the part to be processed B.

This method for incrementally forming also includes holding the periphery of the metal plate W together with the template P4 by the fixing jig 1 to fix the metal plate W and the template P4, to incrementally form the part to be processed F by the tool T. In addition, by the method for incrementally forming, the shape fixability of the edges of the part to be processed F is increased at the part where the template P3 is arranged. As a result, the tension of the vertical wall (molded surface) of the part to be processed F is increased to suppress the deformation of the part to be processed F. In this way, the part to be processed F is formed in high dimensional precision.

Figure 14:
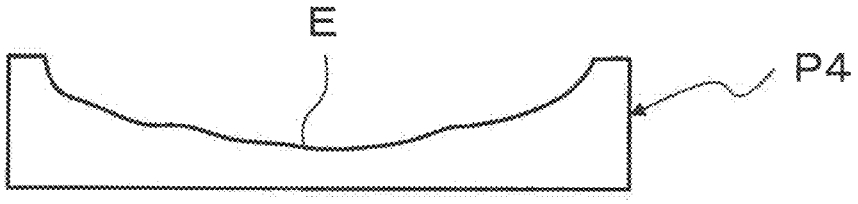
FIG. 14 is a plan view of the template illustrated in FIG. 13.
Figure 15:
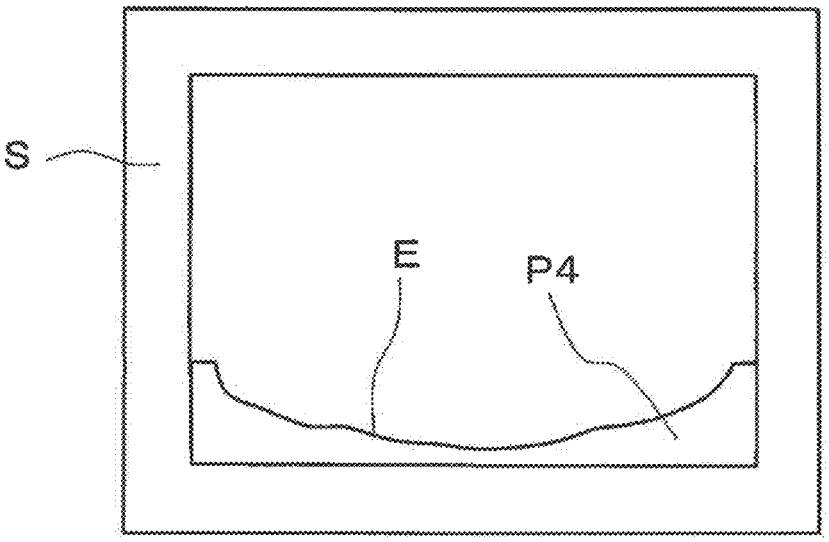
FIG. 15 is a plan view illustrating another example of the template illustrated in FIG. 13.

Note that, as illustrated in FIG. 14, the template P4 needs at least to have a size to be capable of being held by the fixing jig 1, and to include the molded edge E. Alternatively, as illustrated in FIG. 15, the template P4 may have a structure integrated with a frame-like spacer S to be held by the fixing jig 1, or may have a structure capable of being attached to and detached from the spacer S. In particular, the spacer S, which has the structure capable of being attached to and detached from the template P4, is a versatile component common to templates of a plurality of types and thus, can contribute to bringing about further reducing cost of equipment and the like.

Fifth Embodiment

Figure 16:
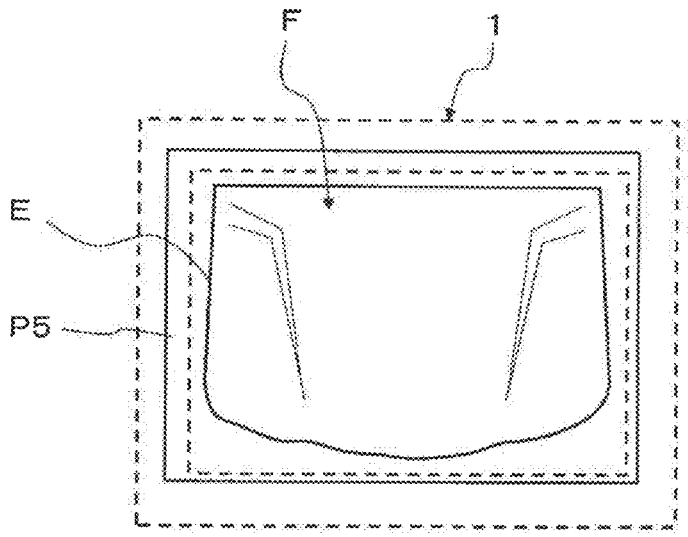
FIG. 16 is a plan view illustrating a fifth embodiment of the method for incrementally forming.

In a method for incrementally forming illustrated in FIG. 16, a template P5 including the molded edge E corresponding to an entire periphery of the contour of the part to be processed F is used. By this method for incrementally forming, the shape fixability is increased by the template P5 in a manner of following the entire periphery of the edges of the part to be processed F. As a result, the tension of the vertical wall (molded surface) of the part to be processed F is increased to suppress the deformation of the part to be processed F. In this way, by this method for incrementally forming, the part to be processed F is formed in high dimensional precision.

In addition, the metal plate (blank material) W to be used in the method for incrementally forming employing the template P5 may be sized in accordance with the part to be processed F. With this, in the method for incrementally forming, the size of the metal plate W can be reduced to a requisite minimum to increase a yield of material.

Sixth Embodiment

Figure 17:
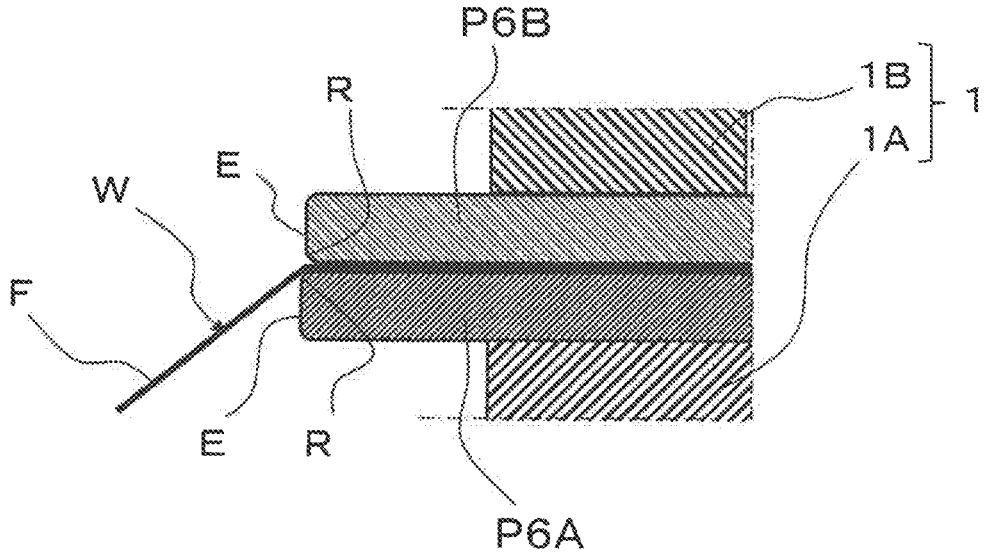
FIG. 17 is a cross-sectional view illustrating a sixth embodiment of the method for incrementally.

In a method for incrementally forming illustrated in FIG. 17, a template P6A arranged on the other side (lower side) of the metal plate W, and a second template P6B including the molded edge E having the same shape as the shape of the molded edge E of this template P6A and arranged on the one side (upper side) of the metal plate W are used. Note that, the second template P6B may correspond to an entirety or a part of the template P6A on the lower side.

This method for incrementally forming also includes holding the periphery of the metal plate W together with the templates P6A and P6B by the fixing jig 1 to fix the metal plate W and the templates P6A and P6B, to incrementally form the part to be processed F by the tool T. In addition, by the method for incrementally forming, the shape fixability of the edges of the part to be processed F is increased at parts where the templates P6A and P6B are arranged. As a result, the tension of the vertical wall (molded surface) of the part to be processed F is increased to suppress the deformation of the part to be processed F. In this way, the part to be processed F is formed in high dimensional precision.

In addition, in the method for incrementally forming, the incremental forming is performed with the templates P6A and P6B arranged on both sides of the metal plate W. Thus, force of restraining the metal plate W is further increased, and the spring-back of the metal plate W is more reliably prevented. In this way, by the method for incrementally forming, the shape fixability of the edges is further increased, and the dimensional precision of the part to be processed (molded product) F is further increased.

The configuration of the method for incrementally forming according to the present invention are not limited to those in the embodiments described above, and appropriate changes may be made to the configuration within the gist of the present invention. The metal plate need not necessarily be set in the horizontal posture, and may beset in a perpendicular state or an inclined state. Further, the fixing jig to be used may be movable such that the tool and the metal plate are moved relative to each other.

Still further, the method for incrementally forming is applicable to forming of various parts to be processed each having a three-dimensional shape. The method for incrementally forming is particularly suited to manufacturing of parts to be processed different from vehicle type to vehicle type, such as vehicle body panels for automobiles and thus, is significantly effective in bringing about reducing cost of equipment and manufacturing.

REFERENCE SIGNS LIST

1 Fixing jig
E Molded edge
F Part to be processed
P1 to P5 Template
P6A and P6B Template
T Tool
W Metal plate
θ Forming angle

The invention claimed is:

1. A method for incrementally forming, from a metal plate, a part having a three-dimensional shape with an outer contour by using a tool disposed on a first surface of the metal plate, the method comprising:

holding, using a fixing jig:

(i) a periphery of the metal plate, (ii) a template including a molded edge that follows a portion of the outer contour of the three-dimensional shape, wherein the fixing jig has a first side separated from the outer contour of the three-dimensional shape by a first distance, and a second side separated from the outer contour of the three-dimensional shape by a second distance, the first distance being greater than the second distance, and (iii) a spacer, wherein:

the template is located on a second surface of the metal plate opposite the first surface, in a region extending from the first side of the fixing jig to the outer contour of the three dimensional shape, and the spacer is located in a region of the second side of the fixing jig where the template is absent; and moving the tool while pressing the tool against the first surface of the metal plate to incrementally form the part having the three-dimensional shape.

2. The method for incrementally forming according to claim 1, wherein the template has a rounded shape at a corner portion of the template with which the metal plate is held in contact.

3. The method for incrementally forming according to claim 2, using a second template, the second template including a molded edge having a same shape as a shape of the molded edge of the template and arranged on the first surface of the metal plate, to incrementally form the part having the three-dimensional shape.

4. The method for incrementally forming according to claim 1, using a second template, the second template including a molded edge having a same shape as a shape of the molded edge of the template and arranged on the first surface of the metal plate, to incrementally form the part having the three-dimensional shape.

5. The method for incrementally forming according to claim 1, using a second template, the second template including a molded edge having a same shape as a shape of the molded edge of the template and arranged on the first surface of the metal plate, to incrementally form the part having the three-dimensional shape.

6. The method for incrementally forming according to claim 1, using a second template, the second template including a molded edge having a same shape as a shape of the molded edge of the template and arranged on the first surface of the metal plate, to incrementally form the part having the three-dimensional shape.

7. A method for incrementally forming, from a metal plate, a part having a three-dimensional shape with an outer contour by using a tool disposed on a first surface of the metal plate, the method comprising, holding, using a fixing jig:

a periphery of the metal plate, (ii) a template including a molded edge that follows a portion of the contour of the three-dimensional shape, and (iii) a spacer; and moving the tool along a path while pressing the tool against the first surface of the metal plate to incrementally form the part having the three-dimensional shape, the path includes a region at which the path changes from a first direction to a second direction, wherein:

the template is located at the region at which the path changes from the first direction to the second direction, and the spacer is located in a region of the second side of the fixing jig where the template is absent.

8. The method for incrementally forming according to claim 7, wherein the template has a rounded shape at a corner portion of the template with which the metal plate is held in contact.

9. A method for incrementally forming, from a metal plate, a part having a three-dimensional shape with an outer contour by using a tool disposed on a first surface of the metal plate, the method comprising, holding, using a fixing jig:

i) a periphery of the metal plate, (ii) a template including a molded edge that follows a portion of the outer contour of the three-dimensional shape, wherein the fixing jig has a first side extending along a first portion of the three-dimensional shape having a first forming angle, and a second side extending along a second portion of the three-dimensional shape having a second forming angle, wherein the first and second forming angle are angles to be formed between a surface of the metal plate before the forming and a surface of the three-dimensional shape of the respective first and second portions, and wherein the first forming angle is less than the second forming angle, and (iii) a spacer, wherein:

the template is located on a second surface of the metal plate opposite the first surface, in a region extending from the first side of the fixing jig to the first portion of the three dimensional shape, and the spacer is located in a region of the second side of the fixing jig where the template is absent;

moving the tool while pressing the tool against the first surface of the metal plate to incrementally form the part having the three-dimensional shape.

10. The method for incrementally forming according to claim 9, wherein the template has a rounded shape at a corner portion of the template with which the metal plate is held in contact.

* * * * *